US005383389A

United States Patent [19]

Wolff et al.

[11] Patent Number: 5,383,389

[45] Date of Patent: Jan. 24, 1995

[54] AMMUNITION INDEXING MECHANISM

[75] Inventors: Peter C. Wolff, Georgia; Stephen J. Bullis, Colchester; Larry W. Hayes, Burlington, all of Vt.

[73] Assignee: Martin Marietta Corporation, Philadelphia, Pa.

[21] Appl. No.: 83,554

[22] Filed: Jun. 29, 1993

[51] Int. Cl.[6] ..... F41A 9/30; F41A 9/37

[52] U.S. Cl. ..... 89/33.04; 89/33.25; 89/137; 89/169; 89/170

[58] Field of Search ..... 89/33.04, 33.16, 33.25, 89/137, 169, 170

[56] References Cited

U.S. PATENT DOCUMENTS 3,417,657 12/1968 Maillard et al. ..... 89/33.04

4,069,740 1/1978 Hottinger et al. ..... 89/33.04

FOREIGN PATENT DOCUMENTS 798825 5/1936 France ..... 89/33.25

*Primary Examiner*—Stephen C. Bentley

*Attorney, Agent, or Firm*—Geoffrey H. Krauss

[57] ABSTRACT

An ammunition indexing mechanism for moving, responsive to actuation of a trigger mechanism, a cartridge from a selected one of a pair of opposed feedports in a weapon receiver and into alignment with a firing chamber of a barrel assembly of the weapon, has a rotary mechanism for moving through a selected index angle each ammunition cartridge entering through the selected feedport; and a torque assembly for storing energy, responsive to a selected movement of the barrel assembly, until released to operate the rotary mechanism to move, for each selected barrel assembly movement, each sequential cartridge through similar angular displacement to a position aligned with the firing chamber.

13 Claims, 10 Drawing Sheets

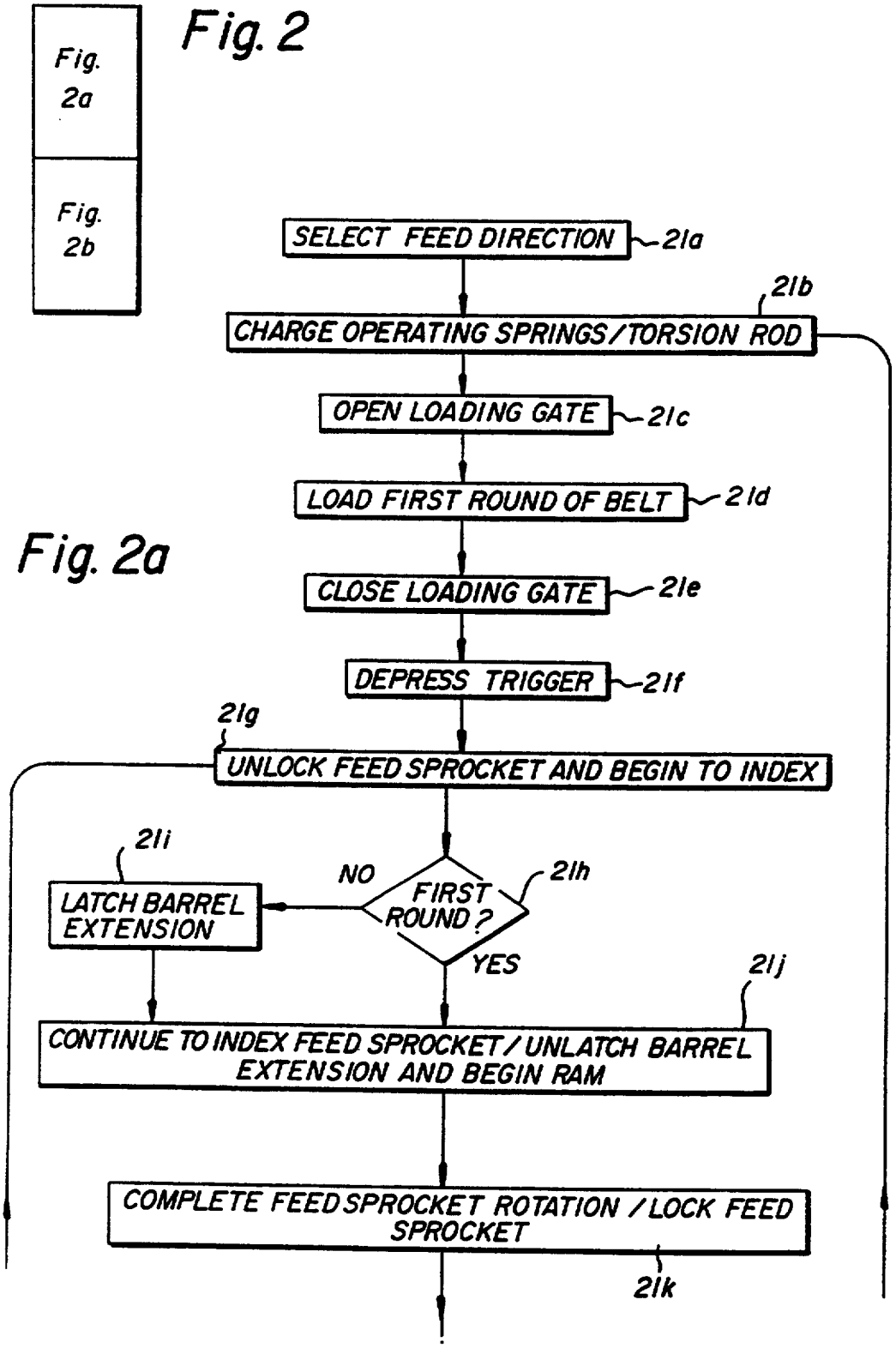
Fig. 2a
Fig. 2b
Fig. 2
SELECT FEED DIRECTION
21a
21b
CHARGE OPERATING SPRINGS/TORSION ROD
OPEN LOADING GATE
21c
LOAD FIRST ROUND OF BELT
21d
Fig. 2a
CLOSE LOADING GATE
21e
DEPRESS TRIGGER
21f
21g
UNLOCK FEED SPROCKET AND BEGIN TO INDEX
21i
NO
21h
LATCH BARREL EXTENSION
FIRST ROUND ?
YES
21j
CONTINUE TO INDEX FEED SPROCKET / UNLATCH BARREL EXTENSION AND BEGIN RAM
COMPLETE FEED SPROCKET ROTATION / LOCK FEED SPROCKET
21k 19
20
20a
20b
20b'
20b''
22
23
23a
23b
23c
23f
23s
23s'
23s''
31
31a
31b
31c
31d
32
32a
32b
32c
34
34a
34b
34c
34d
34e
34f
34g
34i
36
36a
36b
36c
36W-a'
36W-b
36W-l
36W-r
38
38a
40
41
41c
41i
42
42a
42b
42e
42i
42p
42r
44
45
141
151
3''
4

AMMUNITION INDEXING MECHANISM

BACKGROUND OF THE INVENTION

The present invention relates to projectile-firing weapons and, more particularly, to a novel mechanism for moving ammunition cartridges entering through a selected one of a pair of opposed feedports through a selected indexing angle to a position aligned with the firing chamber formed in a gun barrel.

Modern weaponry often requires a fully automatic cartridge-firing gun in which apparent recoil force is minimized, even when a high rate-of-fire is provided. Such a weapon might beneficially use out-of-battery loading; however, with the attendant reciprocating barrel assembly movement, a special accelerator mechanism must provide the necessary forward acceleration (ramming) of the cartridge axially into the firing chamber, prior to firing, and rearward acceleration for the extraction of the spent cartridge. It is highly desirable to provide an accelerator mechanism that minimizes non-axial dimensions and movements, as well as one which provides axial movement over distances greater than the distance through which an initiating input must move. Most versatile operation dictates that the desired out-of-battery operation be provided with ambidextrous feed, i.e. with the weapon accepting feeding through either side of the receiver of a sequence of ammunition cartridges which are linked together in a belted configuration, and operating with the reciprocating barrel assembly.

BRIEF SUMMARY OF THE INVENTION

In accordance with the present invention, a novel ammunition indexing mechanism for moving a cartridge from a selected one of a pair of opposed feedports in a weapon receiver and into alignment with a firing chamber of a barrel assembly, responsive to actuation of a trigger mechanism, includes: means for selecting one of the pair of feedports through which to pass at least one cartridge for loading into the firing chamber; a rotary mechanism for moving through a selected index angle each ammunition cartridge entering through the selected feedport; and torque means for storing energy, responsive to a selected movement of said barrel assembly, until released to operate said rotary mechanism to move, for each selected barrel assembly movement, one cartridge sequentially to a position aligned with said firing chamber.

In a presently preferred embodiment, the torque means includes: a torque rod having a first end fixedly mounted to the receiver and a second end, opposite to the first end, to which is affixed a wing cam member having first and second complementary camming wings. The barrel assembly has first and second cam rollers, only one of which is moved into abutment with an associated one of the camming wings responsive to the selection of an associated feedport, and is used to torque at least the rod by rotating the abutting cam wing responsive to a selected barrel assembly movement.

Accordingly, it is an object of the present invention to provide a novel ammunition indexing mechanism for use in a cartridge-firing weapon.

This and other objects of the present invention will become apparent upon reading of the following detailed description of a presently preferred embodiment, when considered in conjunction with the associated drawings.

BRIEF SUMMARY OF THE DRAWINGS

FIG. 3*b'* is a bottom view of a wing cam member used in the indexing mechanism;

FIG. 3*b''* is a plan view of a pawl member used in the indexing mechanism;

DETAILED DESCRIPTION OF A PREFERRED EMBODIMENT

Figure 1A:
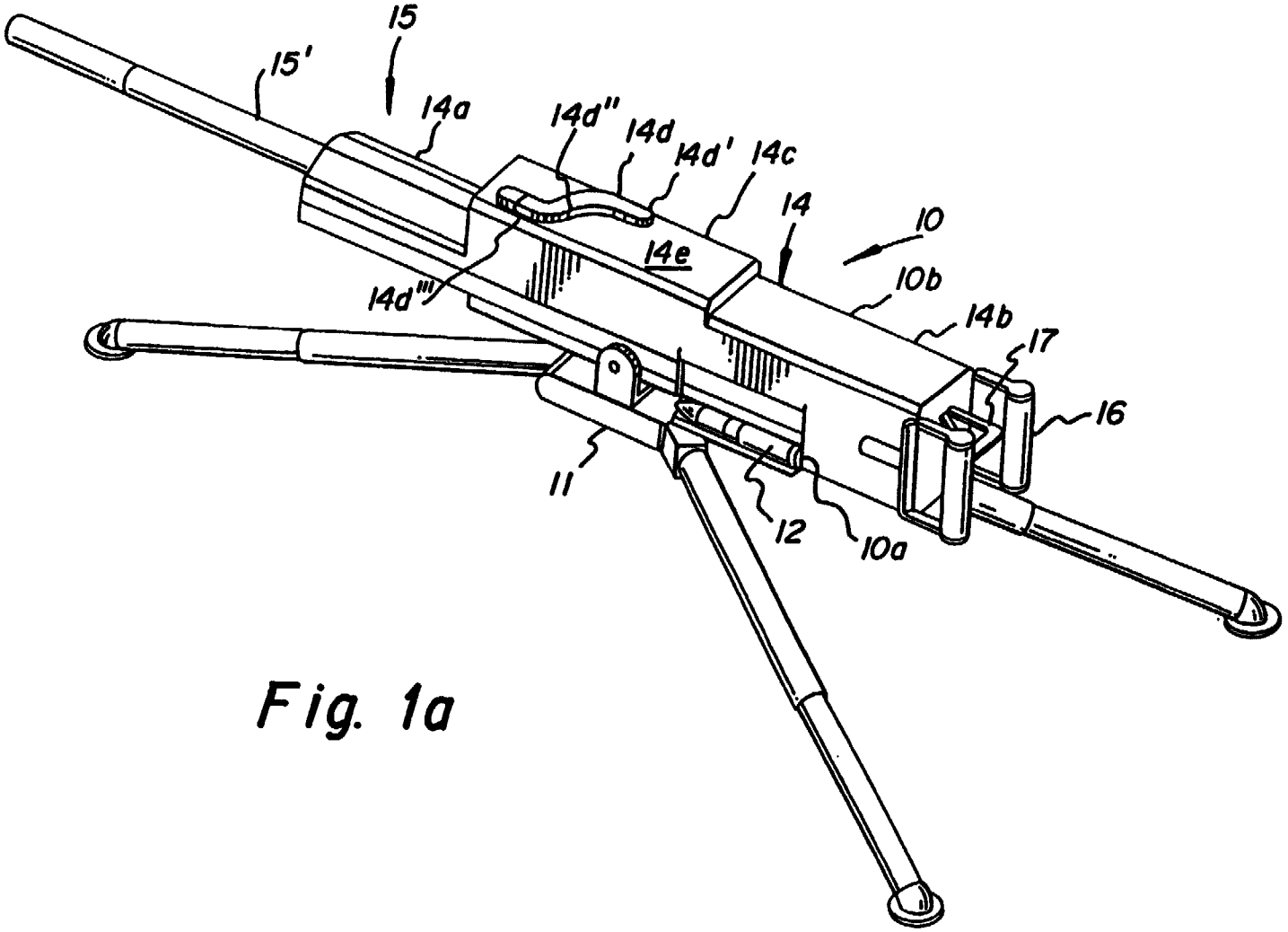
FIG. 1*a* is a prospective view of a weapon utilizing the present invention.
Figure 1B:
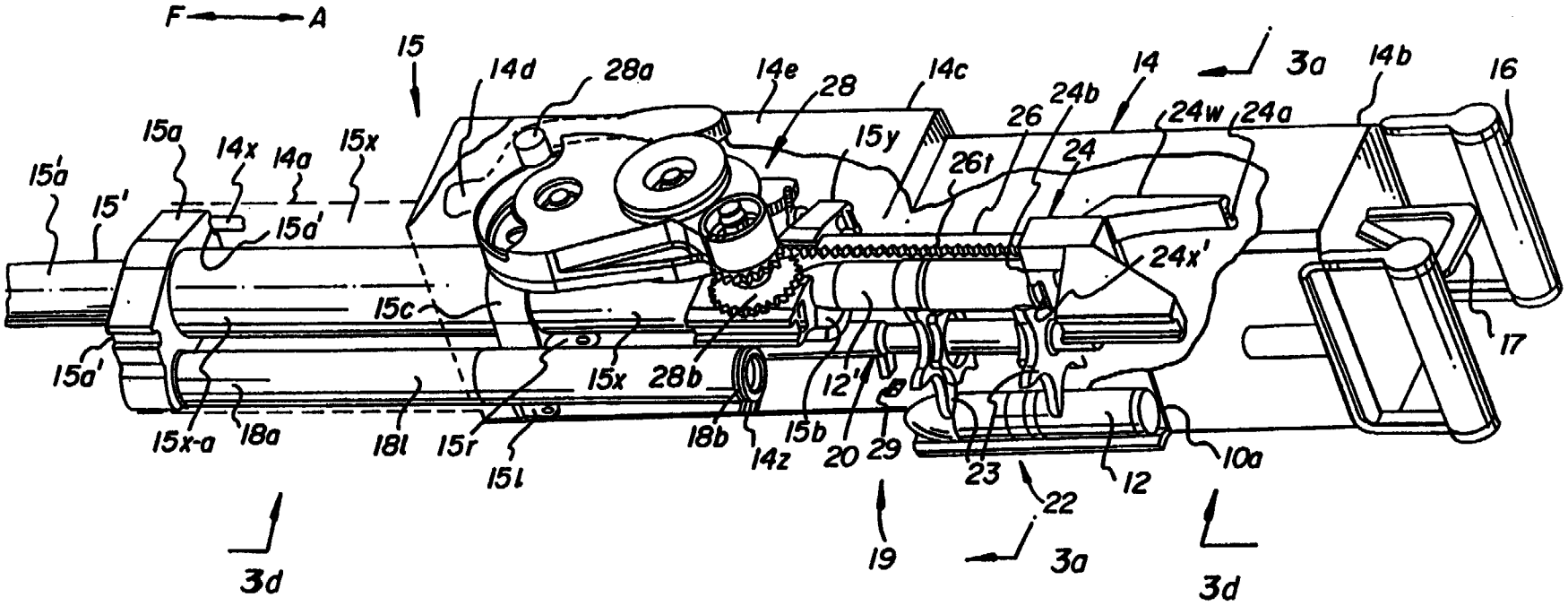
FIG. 1*b* is a partially-sectioned perspective view of the receiver portion of the weapon.
Figure 2B:
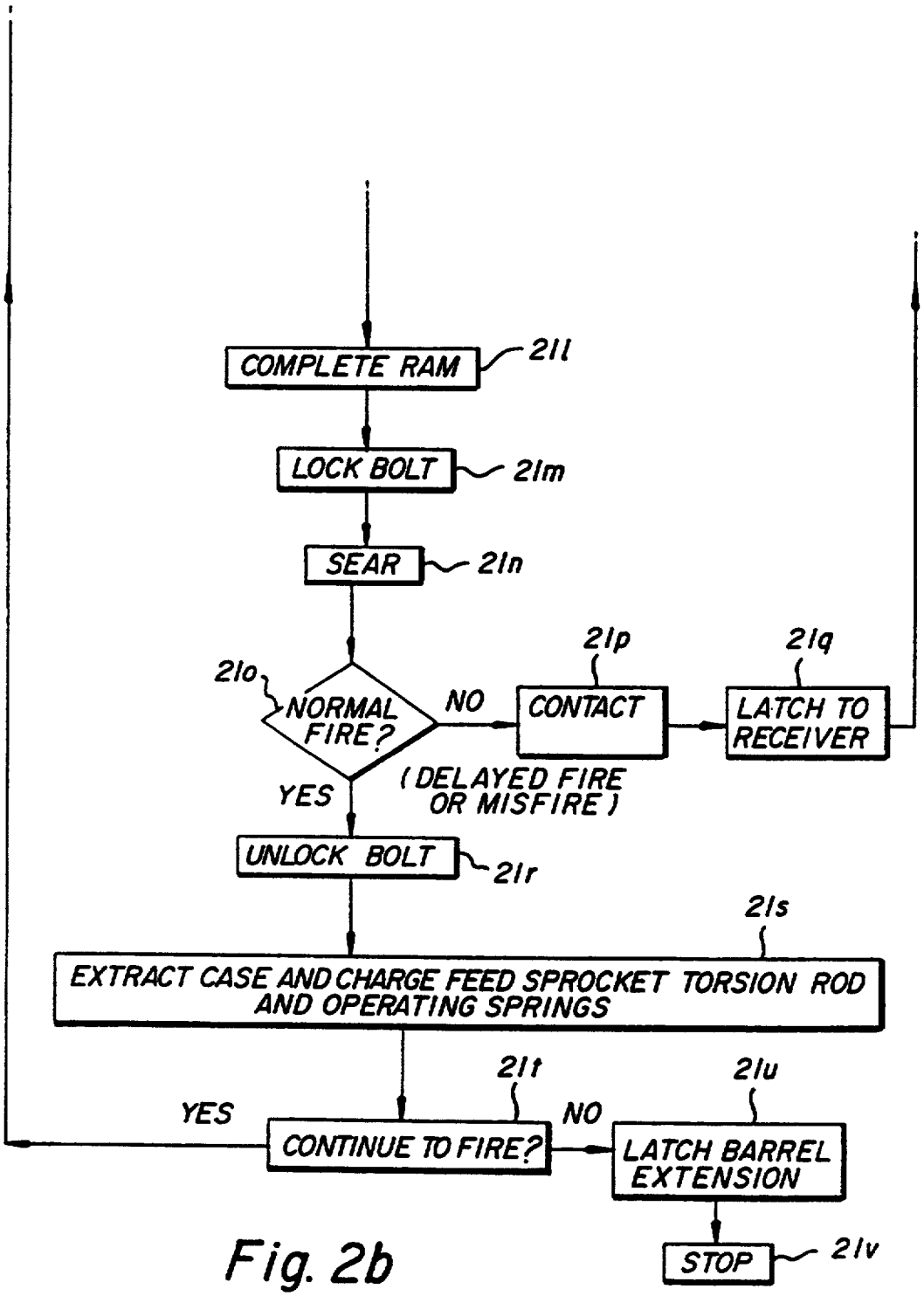
FIG. 2, comprised of FIGS. 2*a* and 2*b*, is a flow chart detailing the steps performed in the operation of the weapon utilizing the present invention.

Referring initially to FIGS. 1*a* and 1*b*, a weapon assembly 10, mountable upon a tripod 11 and the like support mechanism, selectively fires one, a multi-shot burst or a steady stream of projectiles. A stream of cartridges 12 enter one feedport 10*a* of the weapon; there is a feedport adjacent each side of a gun receiver housing 14, with the left-hand feedport 10*a* being shown (an identical feedport 10*b* exists in a complementary position on the right-hand side of the weapon). The weapon includes a barrel assembly 15, having a rifled barrel 15' through which moves projectiles fired from cartridges 12, after the cartridges are moved into position in alignment with the axis of a barrel 15 and then rammed into a firing chamber 15*b* of the barrel, immediately prior to cartridge ignition; the empty, spent cartridge is then extracted by the bolt, moves back to its original position and is rotationally ejected. The stream of fired projectiles is directed by means of a training mechanism 16, utilized in conjunction with a trigger mechanism 17.

The receiver housing 14 has a forward end 14*a* and an aft end 14*b*, as well as an accelerator mechanism housing portion 14*c* including a camming channel 14*d* formed into the upper surface 14*e* thereof. Within forward receiver portion 14*a*, interchangeable barrel 15' fits within, and is retained by, a barrel extension 15*x*, so positioned as to allow the centered cartridge, or round 12', once indexed, or moved into alignment with the barrel axis 15'a, access to the barrel firing chamber 15b. The forward end 15x-a of barrel extension 15x is yoked, via a barrel extension yoke member 15a, to the forward ends 18a of right and left charging compression spring means 18l and 18r (see also FIG. 3d), whose opposite ends 18b are retained in formations 14z of housing 14. Charging spring tube ends 18b remain fixed, so that ends 18a may move rearward, under recoil or charging conditions; under such conditions the conjoint barrel 15', barrel extension 15x, and yoke 15a all move rearward from the position shown, along with a central yoke, or carrier, member 15c, joined to a midsection of the barrel extension, and having right and left cam-roller means 15r/15l carried thereon (see also FIG. 3d). That one of cam rollers 15r/15l actually in use will be determined by the selection of that one of feedports 10a/10b from which ammunition 12 is loaded. The direction of rotation of our novel feed indexing mechanism 19 will be determined, as will the twisting direction of torque means 20 when storing energy for operation of a cartridge movement means 22, by the pre-selection of a feedport 10a or 10b.

In the illustrated embodiment, means 22 operates by rotation of multi-tooth sprocket means 23, which will be caused to turn in either a clockwise direction (loading from left-hand port 10a), or in the counterclockwise direction (loading ammunition from the right-hand feedport 10b); the rotation here is through a 60° angle. The direction of mechanism 19 rotation is selected by operation of means 29 and determines, amongst other actions, which one of cam-roller mechanisms 15r or 15l is brought into contact with a portion of indexing mechanism 20.

The ammunition indexing activity associated with the torque-rotation indexing mechanism 20 occurs prior to a bolt means 24 being released from an aft position, to move forward and carry indexed cartridge 12' into barrel firing chamber 15b. Bolt means 24 is guided on channels 24a (see FIG. 3a) in bolt wings 24w, riding upon longitudinal extrusions 14x formed upon the interior surfaces of housing 14. Barrel yoke 15a has similar channels 15a' operating with other portions of these extrusions 14x. Bolt means 24 is joined to a rack means 26, retained by an aft barrel extension yoke means 15y (itself having channels operating with the receiver extrusions 14x) to move the bolt face 24b into contact with the rear of each cartridge, for accelerating the cartridge into the barrel firing chamber 15b. An accelerator mechanism 28, for accelerating gun bolt 24 towards and away from the barrel 15, includes a camroller 28a, moving in camming channel 14d, as the barrel extension 15x, upon which mechanism 28 is attached, moves longitudinally forward and aft, to turn an accelerator mechanism output gear 28b, which meshes with the teeth 26t of rack means 26, so as to move bolt means 24 forward and aft with displacements, velocities and accelerations greater than that of the barrel 15/barrel extension 15x combination.

Figure 3A:
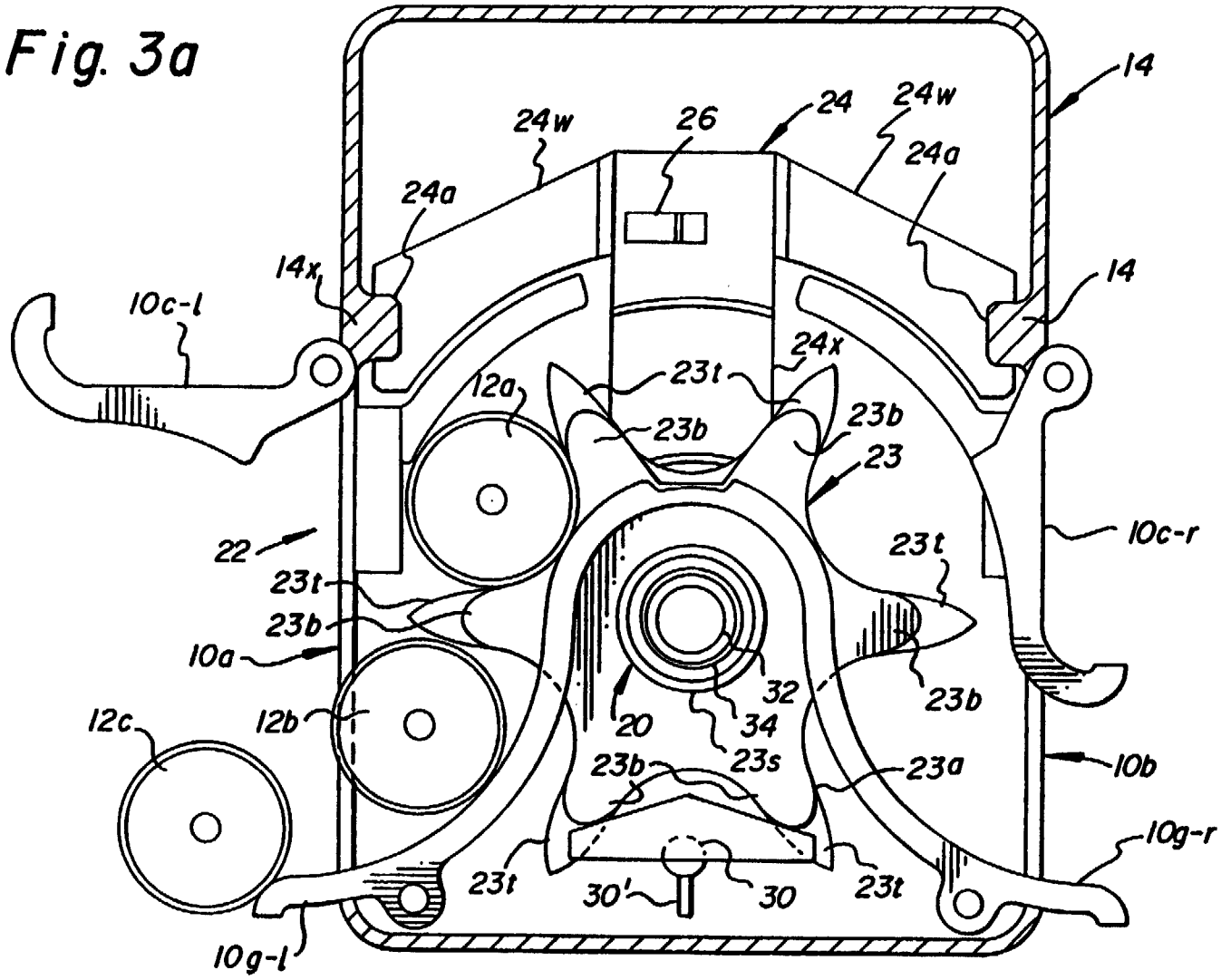
FIG. 3*a* is a sectional view of the weapon housing and of the ammunition loading mechanism, including the novel indexing mechanism of the present invention, taken along the lines 3*a*—3*a* in FIG. 1*b;*
Figures 3B, 3C:
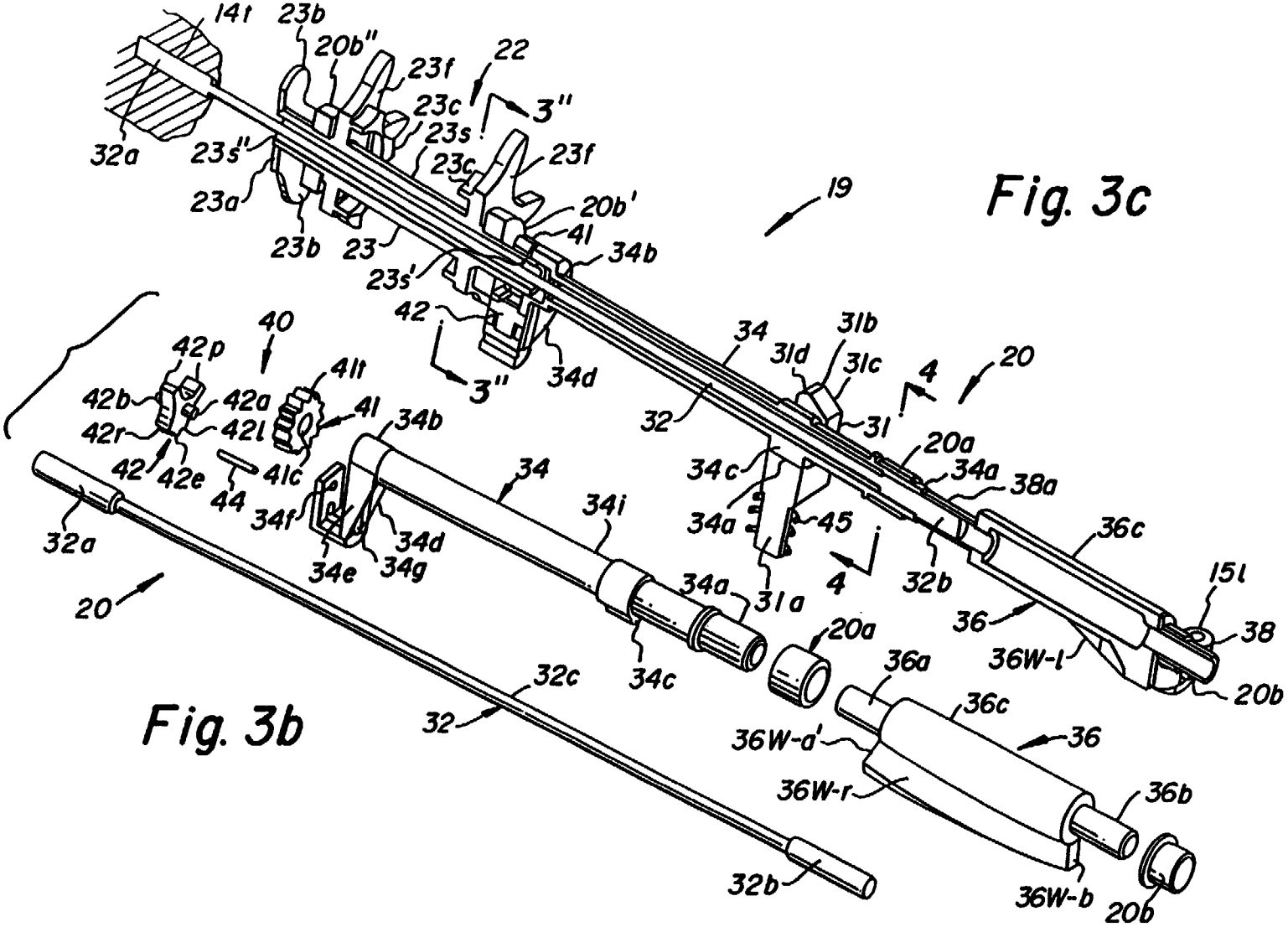
FIG. 3*b* is an exploded prospective view of a portion of the novel ammunition indexing mechanism of the present invention.
FIG. 3*c* is a sectional prospective view of the ammunition loading mechanism of the present invention.
Figures 1, 3B:
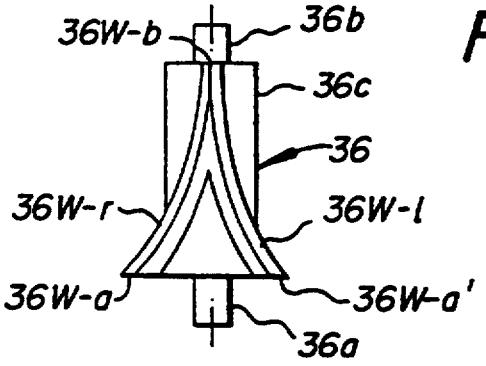
Figures 2, 3B:
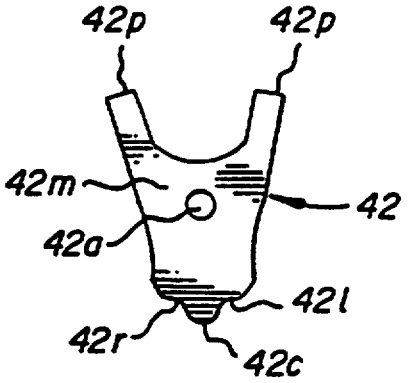

Referring now to FIG. 2, the operation of weapon 10 follows the flow steps 21 illustrated: as previously mentioned, operation of weapon 10 commences (step 21a) with selection of the ammunition feed direction; a bottom-mounted feed direction selector 29 may be provided, for engagement of the proper one of cam-rollers 15r or 15l, and engagement of the proper pawl arm 42p-l or 42p-r, in torque energy-storage assembly 20 (to be discussed in more detail hereinbelow). After selector 29 is operated, step 21b is entered and the operating springs 18 and the torsion rod assembly 20 are charged (i.e. energy is stored therein) by moving rack mechanism 26 to its most extended condition, which carries bolt means 24, accelerator mechanism 28 and barrel assembly 15 to their rear-most positions. After the operating springs 18 are compressed, the barrel extension 15x is latched in this rear-most position (as described hereinbelow). A loading gate 10c (see FIG. 3a) covering the selected loading port 10a/10b is opened (step 21c) and the first round 12 in a belt of cartridges is loaded through the selected loading port (step 21d). Thereafter, the loading gate 10c is closed (step 21e) and the weapon is now "cocked" and ready to fire. The weapon can now be left in a "cocked and locked" condition; when weapon 10 is to be fired, trigger mechanism 17 is pressed (step 21f) and depression of trigger 17 causes a locking means 30' (FIG. 3a) to release a plunger 30 for movement, unlocking feed sprocket means 23 and allowing cartridge movement assembly 22 to rotate, under action of the torque energy-storage means 20, to rotate a cartridge 12 into chamber-aligned position (step 21g). The barrel extension 15x has a latch means 31, best shown in FIGS. 4a and 4b, and the condition of latch 31 is considered in step 21h; if a round has been immediately previously fired, the barrel extension 15x must have returned to the rearward position and be latched by member 31 (step 21i) before step 21j is entered, whereas if a round has not been previously immediately fired, the present round to be fired is considered the first round of a new sequence and step 21j is immediately entered from step 21h, because the barrel extension was previously latched. In step 21j, the feed sprockets 23 continue to turn until round 12 is indexed with the barrel, and then the barrel extension 15x is unlatched and begins to move forward, in the direction of arrow F, under the force of expanding charging springs 18, while accelerator mechanism 28 moves bolt means 24 to ram the indexed and aligned cartridge 12' into firing chamber 15b. Typically, barrel 15, barrel extension 15x and the firing chamber 15b thereof will move forward about four inches, in an out-of-battery loading action in which accelerator mechanism 28 causes bolt means 24 to move forward almost ten inches, so that the indexed cartridge 12' fully enters chamber 15b. When the feed sprocket 23 rotation is complete, utilizing the torque energy provided by torque assembly 20, cartridge movement means 22 ceases to move, sprocket member 23 is locked (step 21k) and step 21l is entered, signalling completion of forward ramming action of bolt means 24. At the forward bolt position, bolt means 24 is locked, by known means not shown, to the barrel aft yoke 15y (step 21m). After the bolt is locked to the barrel extension yoke, the sear operation (step 21n) occurs and the firing pin (also not shown) is actuated to initiate cartridge primer detonation. In the event that a normal cartridge detonation (step 21o) does not occur, the delayed fire or misfire occurrence will cause (step 21p) the forward-traveling barrel/extension/bolt mass to contact a buffer (not shown), and be latched to the receiver (step 21q); thereafter, operation returns to step 21b, wherein the torsion rod mechanism 20 and operating spring mechanism 18 must be recharged. If a normal cartridge detonation occurs in step 21o, after a delay to allow the projectile to exit the barrel, bolt means 24 is unlocked (step 21r) and the fired cartridge casing is extracted (step 21s) from barrel breach 15b during rear-ward recoil in the direction of arrow A, along with recharging of both the feed sprocket torsion rod means 20 and operating springs 18, as will be more fully discussed hereinbelow. Thereafter, step 21*t* is entered and the trigger 17 used to set means 30' to allow plunger 30 to determine either that firing will continue (with a return to step 21*g*), or that firing will cease, whereby step 21*u* is entered, and barrel extension 15*x* is latched by latch means 31, so that the mechanism stops (step 21*v*), but is in condition to re-commence firing when the trigger mechanism 17 is next actuated.

Referring to FIG. 3*a*, the cartridge loading steps involve selecting that one of left feedport 10*a* or right feedport 10*b* through which a belt of linked cartridges 12 are to move; this selection may be started by movement of selector means 29, or may commence with opening the feedport cover 10*c* associated with the chosen direction (the cover then being linked to internal selector means)—here, the left cover 10*c*-l has been opened and cartridge 12*a* has been placed between the pair of sprocket teeth 23*t* at the 10 o'clock position (as seen from the aft end of the weapon). The linked cartridges 12*a*, 12*b*, 12*c*, etc. are guided into the feedport on a guide means 10*g* (here, the left port guide rail 10*g*-*l*). Note the bolt means 24 and its bolt face extension 24*x*, which will be aft of the cartridge, once the cartridge is moved clockwise to the 12 o'clock position by the sprocket means 23 of the indexing mechanism.

Figure 3D:
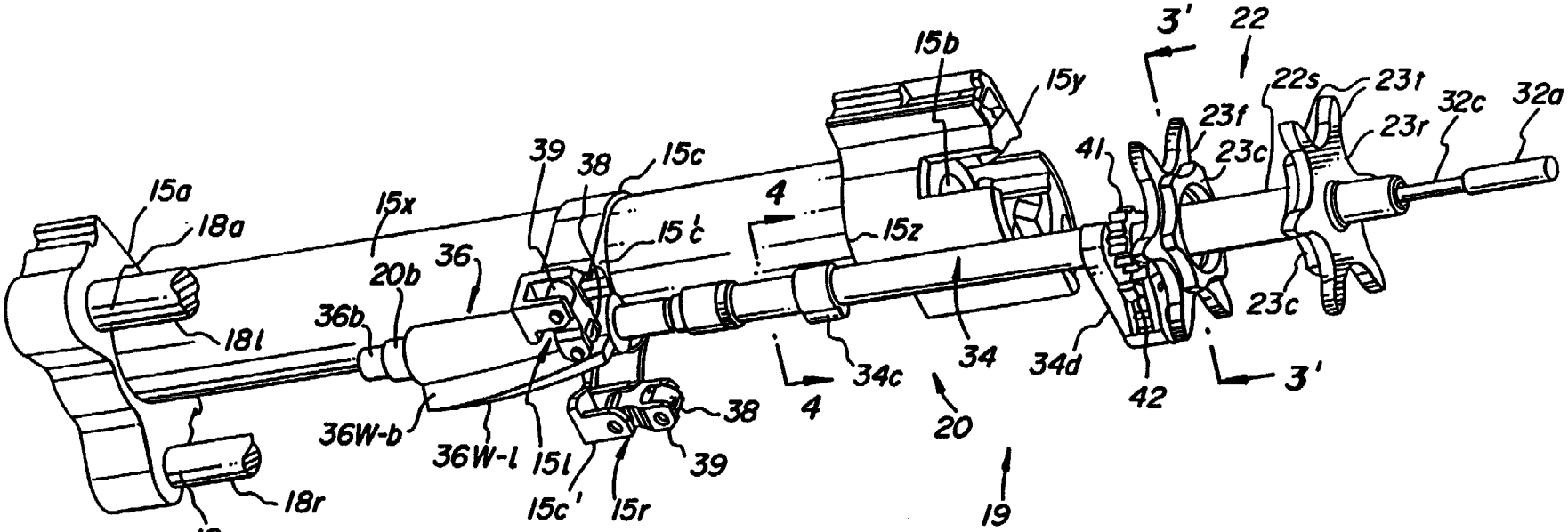
FIG. 3*d* is a bottom view of the novel indexing mechanism, taken along the lines 3*d*—3*d* in FIG. 2.

Referring now also to FIGS. 3*b*–3*d* and 3*b*', the cartridge indexing mechanism 19, in accordance with the present invention, comprises torque energy-storage means 20 and cartridge movement 22. Torsion assembly 20 (FIG. 3*b*) has a central torsion rod 32 having a first end 32*a* which is immovably maintained within a housing aperture 14*t*. An opposite torsion rod end 32*b* is force fit into a first end 34*a* of a torsion tube 34, which coaxially encloses part of the central shaft 32*c* of the rod. A portion of rod end 32*b* is also force fit into a first end 36*a* of a wing cam member 36 which axially extends from torsion tube 34. Rod end 32*b* and its coaxial torsion tube end 34*a* and wing cam end 36*a* are supported by a support means 20*a*, such as a bushing or bearing. An opposite end 36*b* of wing cam member 36 is supported by another support means 20*b*. The wing cam 36 has a pair of camming wings 36*w* (best seen in FIG. 3*b*') with a forward portion of the right cam wing 36W-*r* and a forward portion of the left cam wing 36W-*l* joined together in a unitary edge 36W-*b* adjacent to the cam front end 36*b* and curving into separated wing ends 36W-*a*/36W-*a*' adjacent to cam member aft end 36*a*. The outer camming surface of one of camming wings 36W is contacted by a selected one of rollers 38 of an active one of the pair of cam roller means 15*r* or 15*l*; the selection is responsive to feed selector means 29. In the illustrated embodiment, wherein left feedport 10*a* has been selected by means 29, left cam roller means 15*l* is moved such that its roller 38 is pressed against the left cam wing 36W-*l* (FIG. 3*d*) while the right cam roller 15*r* is moved such that its roller 38 is removed from the right cam wing. Each roller 38 is held by a clevis 39 arranged to the barrel extension carrier yoke member 15*c*. Thus, in the uncocked (rest) condition, the barrel and barrel extension are forward, so that carrier element 15*c* is sufficiently forward to cause roller 38 to abut the cam wing at the central end 36W-*b* thereof. As the mechanism is charged and the barrel extension is moved aft to charge operating springs 18, the barrel extension also moves carrier element 15*c* in the aft direction; the engaged roller 38 (here roller 38*l*) also moves aft and pushes against the abutting cam wing 36W (here, left wing 36W-*l*) to rotate the concentric torsion tube 34 and its coaxially-contained torsion rod 32 (here, in the counterclockwise direction, as seen from the aft or trigger-end of the housing).

An intermediate portion 34*i* of the torsion tube 34 carries a cam member portion 34*c*, which will be used to unlock the barrel extension 15*x*. The torque tube also carries at its aft end 34*b* a housing 34*d* for a ratchet-pawl means 40 which cooperates with the sprocket means 23 and the plunger means 30 (FIG. 3*a*) of the trigger mechanism, to rotationally lock the entire torsion indexing means 19, unless a round is to be fired. Means 40 includes a ratchet gear 41, having a central aperture 41*c* into which a forward extension 23*s*' of the shaft 23*s* of the sprocket means is fixed; a pawl 42 (see also FIG. 3*b*'') has a body member 42*m* with forward and aft axial extensions 42*a*/42*b* which fit into forward and aft apertures 34*e*/34*f* in the housing portion 34*d*. The pawl has a center lobe 42*c* between, and partially defining, first and second depressions 42*l* and 42*r*. A spring-loaded direction selector pin 44 operates in channel 34*g*, responsive to the feed-direction selector means 29, and is moved into one of depressions 42*l* (for left-hand feed) or 42*r* (for right-hand feed) selected to tilt the pawl member 42 such that the ratchet teeth 41*t* can be contacted by that one of the pawl arms 42*p* necessary to enable ratchet gear 41 rotation only in the correct feed direction, as will be explained with respect to FIGS. 3*e*–3*h* hereinbelow.

The cartridge movement assembly 22 has a sprocket means 23 with a sprocket tube 23*s* coaxially positioned about torsion rod 32; the tube has a forward end extension 23*s*' on which the ratchet gear 41 is mounted, and an aft end extension 23*s*'' from which a buffer element 23*a* integrally extends. Extensions 23*s*' and 23*s*'' are respectively journaled in respective support means 20*b*' and 20*b*''. Tube 23*s* is integrally joined to a forward toothed sprocket 23*f* and a rear toothed sprocket 23*r*. The sprockets each have the same number of axially-aligned teeth 22*t* (here, six teeth, each at a 60° angle to the adjacent pair of teeth), with buffer element 23*a* also having a plurality of lobes 23*b* not only equal in number to the number of cartridge-supporting teeth 23*t* on each of the sprockets 23*f* and 23*r*, but also in axial alignment therewith. A central reinforcement portion 23*c* is provided between the sprockets. As will be seen in FIG. 3*a*, the plunger 30 of the firing mechanism presses upward against two buffer element lobes 23*b*, to prevent the entire cartridge movement assembly 22, and the torque assembly 20 locked thereto, from turning, until the trigger 17 is depressed and means 30' releases plunger 30.

Referring now to FIGS. 3*e*–3*h*, taken in the direction of arrows 3''—3'' in FIG. 3*c* (i.e. looking forward from a position to the rear of the forward sprocket 23*f*, which is seen as if transparent), the ratchet pawl mechanism 40 is seen from the aft end. It will be understood that, once the barrel extension 15*x* is drawn back towards the receiver aft portion 14*b*, and torsional energy is stored in torsion assembly 20, prevention of indexing mechanism 19 from twisting in the opposite (untorqueing) direction is solely due to the blocking action of plunger 30 (see FIG. 3*a*). Once plunger 30 is released, the engaged arm 42*p* of the pawl pushes against an abutting tooth 41*t* of gear 41 (which is affixed, as by a spline, to the sprocket shaft extension 23*s*'), and rotation occurs in the opposite direction from the direction taken by the wing cam in storing the energy.

Consider first (FIGS. 3e/3f) the case of feeding from right-hand feedport 10b: the first cartridge 12a in a belt has been positioned at the 2 o'clock location, within the "pocket" 19p under right feedport cover 10c-r and is engaged by adjacent sprocket teeth 23t; the torsion rod 32/tube 34 of the indexing mechanism 19 had been torqued when the barrel extension was racked to the rear of the receiver and latched (either before or after the belt is loaded). Thus, as seen in FIG. 3e, the direction shaft 44 has been moved clockwise, to rest in the depression 42r clockwise of the pawl center lobe and select the right-hand feedport for use, and the torsion rod and tube were rotated in a clockwise direction, and locked thereat by the indirect action of the trigger means plunger; means 40 is now at the 8 o'clock position. When a round is to be fired, the plunger is released and the stored torque energy is transmitted, through pawl arm 42p-r to ratchet tooth 41t, so that the sprocket moves in the counterclockwise direction of arrow R, until means 40 is back at the resting 6 o'clock position (FIG. 3f). Cartridge 12a has been rotated up to the 12 o'clock location, in line with, and ready for movement into, firing chamber 15b. Upon firing of cartridge 12a, the recoil moves the barrel/extension/cam roller assembly to the receiver rear 14b, and the right cam roller 38r operates on the associated cam wing 36W-r of the wing cam means 36 to twist the torque tube 34 and rod 32 in the clockwise direction, with the pawl arm 42p-r moving over a ratchet tooth 41t, into position for rotating the next cartridge 12b up to the 12 o'clock position.

Figure 3G:
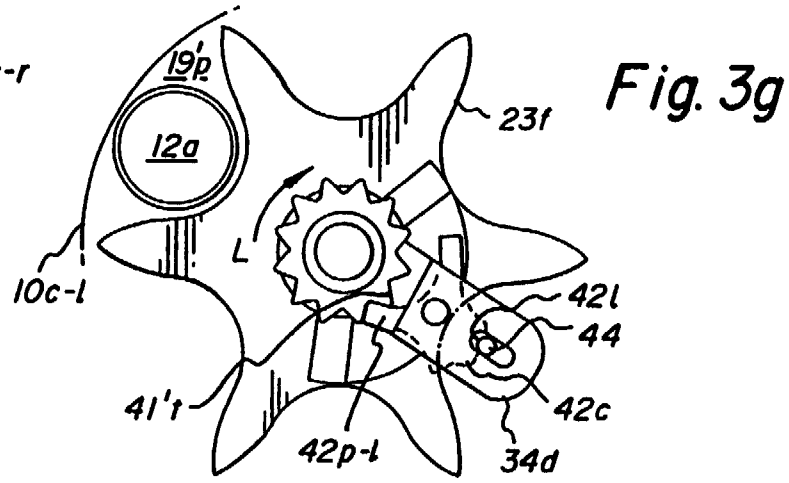
FIGS. 3*e*–3*h* are end views of the sprocket rachet pawl subassembly in the deenergized and energized conditions for respective right-hand and left-hand feed directions, as seen viewed in the direction of arrows 3'—3' in FIG. 3*d;*
Figure 3E:
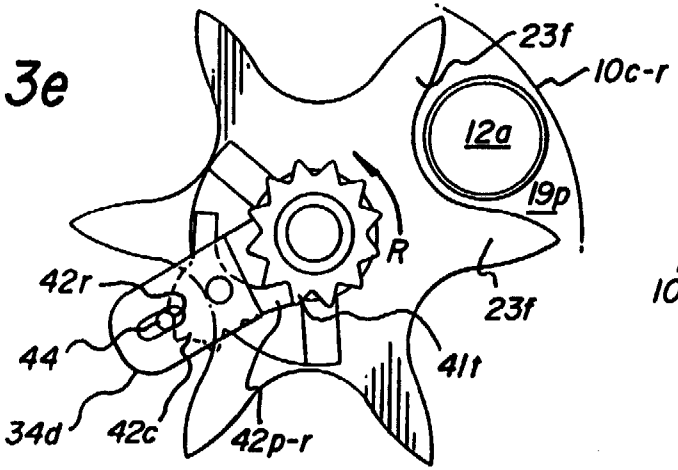
Figure 3H:
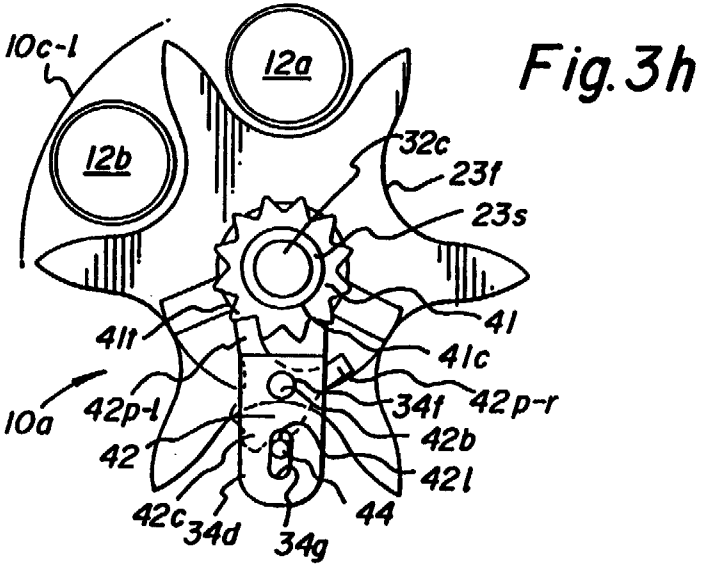
Figure 3F:
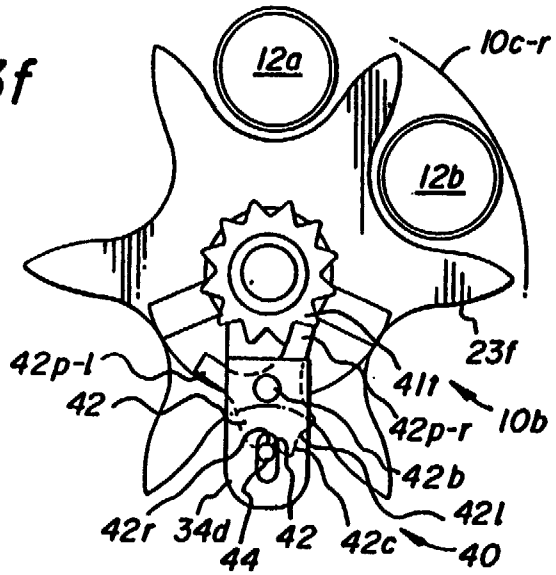

Consider now (FIGS. 3g/3h) the case of feeding from left-hand feedport 10a: the first cartridge 12a in a belt has been positioned at the 10 o'clock location in the pocket 19p'under the left feedport cover 10c-l and is engaged by adjacent sprocket teeth 23t; the torsion rod 32/tube 34 of the indexing mechanism 19 are torqued, as seen in FIG. 3g, to move means 40 counterclockwise to the 4 o'clock position, responsive to the direction shaft 44 having been moved to rest in the depression 42l counter-clockwise of the pawl center lobe 42c and select the left-hand feedport for use. When a round is to be fired, the plunger is released and the stored torque energy is transmitted, through pawl arm 42p-l to ratchet tooth 41t, so that the sprocket moves in the clockwise direction of arrow L, until means 40 is back at the resting 6 o'clock position (FIG. 3h). Cartridge 12a has been rotated up to the 12 o'clock location, in line with, and ready for movement into, firing chamber 15b. Upon firing of cartridge 12a, the recoil moves the barrel/extension/cam roller assembly to the receiver rear 14b, and the left cam roller 38 operates on the left cam of the wing cam means 36 to twist the torque tube 34 and rod 32 in the counterclockwise direction, with the pawl arm 42p-l moving over a ratchet tooth 41t' (actually, the face of the tooth opposite to the face over which the pawl arm 42p-r moves for the opposite feed direction), into position for rotating the next cartridge 12b up to the 12 o'clock position.

If release mechanism 30' allows the plunger to again be overridden by the sprocket lobes 22b, a next round is rotated into position and the entire firing sequence repeats. If, on the other hand, mechanism 30' does not allow plunger 30 to move and causes lobes 22b to be held, such that sprocket assembly 22 cannot rotate, the entire torsion assembly 19 remains in the torqued-up condition, ready to index a next round, as well as unlock the barrel and accelerator ram mechanism, for loading and firing the next round when the trigger mechanism is again activated to release plunger 30.

Figure 4A:
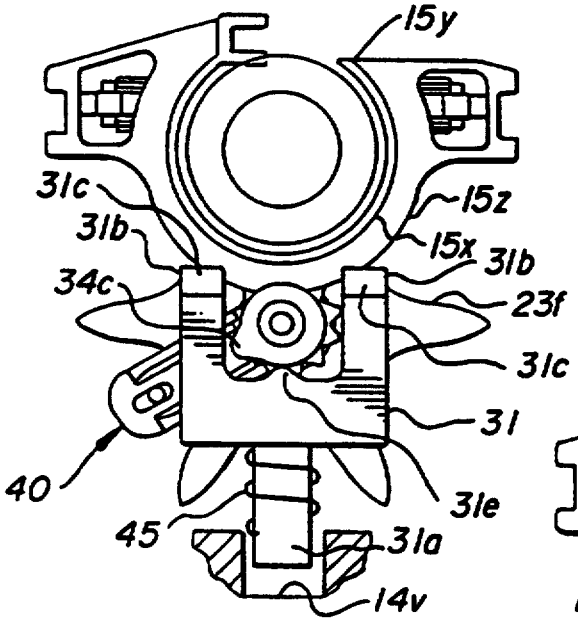
FIGS. 4*a* and 4*b* are sectional views of the barrel extension latch subassembly in the respective latched and unlatched conditions, as viewable in the direction of arrows 4—4 in FIG. 3*c*.
Figure 4B:
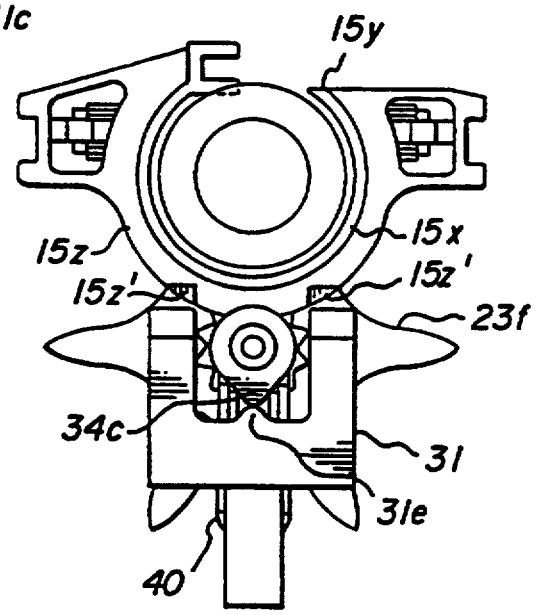

Referring now to FIGS. 4a and 4b, as seen looking in the direction of arrows 4—4 (see FIGS. 3c/3d), the barrel extension 15x is latched in the rearward position by the upward movement of a somewhat U-shaped barrel extension latch member 31, responsive to a spring means 45 formed about a latch extension 31a, moving in an aperture 14v in receiver foreportion 14a. The generally parallel latch arms 31b have canted forward edges 31c (see also FIG. 3c), over which the lower edge 15z of a portion of the barrel extension (e.g. rear yoke 15y) rides and is then prevented from returning forward by the rear latch edges 31d, which are raised by action of the return spring means 45. As the indexing means 19 is torqued-up, means 40 has been moved to the side (FIG. 4a) and the aligned camming lobe 34c is not contacting the camming formation 31e on the latch, so that the latch 31 is not depressed and its arms 31b remain in contact with the barrel extension yoke and prevent forward barrel motion. When the cartridge indexing mechanism 19 operates, the torque tube/rod is released for rotation and the camming lobe 34c rotates to urge formation 31e downward; arms 31b move down by an amount sufficient to allow the operating springs 18 to push the barrel extension forward, with lock portions 15z' passing over the latch arm ends 31d; further forward motion, under force of the compressed spring means 18 causes ramming of the cartridge into the firing chamber, where subsequent cartridge ignition occurs.

Figure 4C:
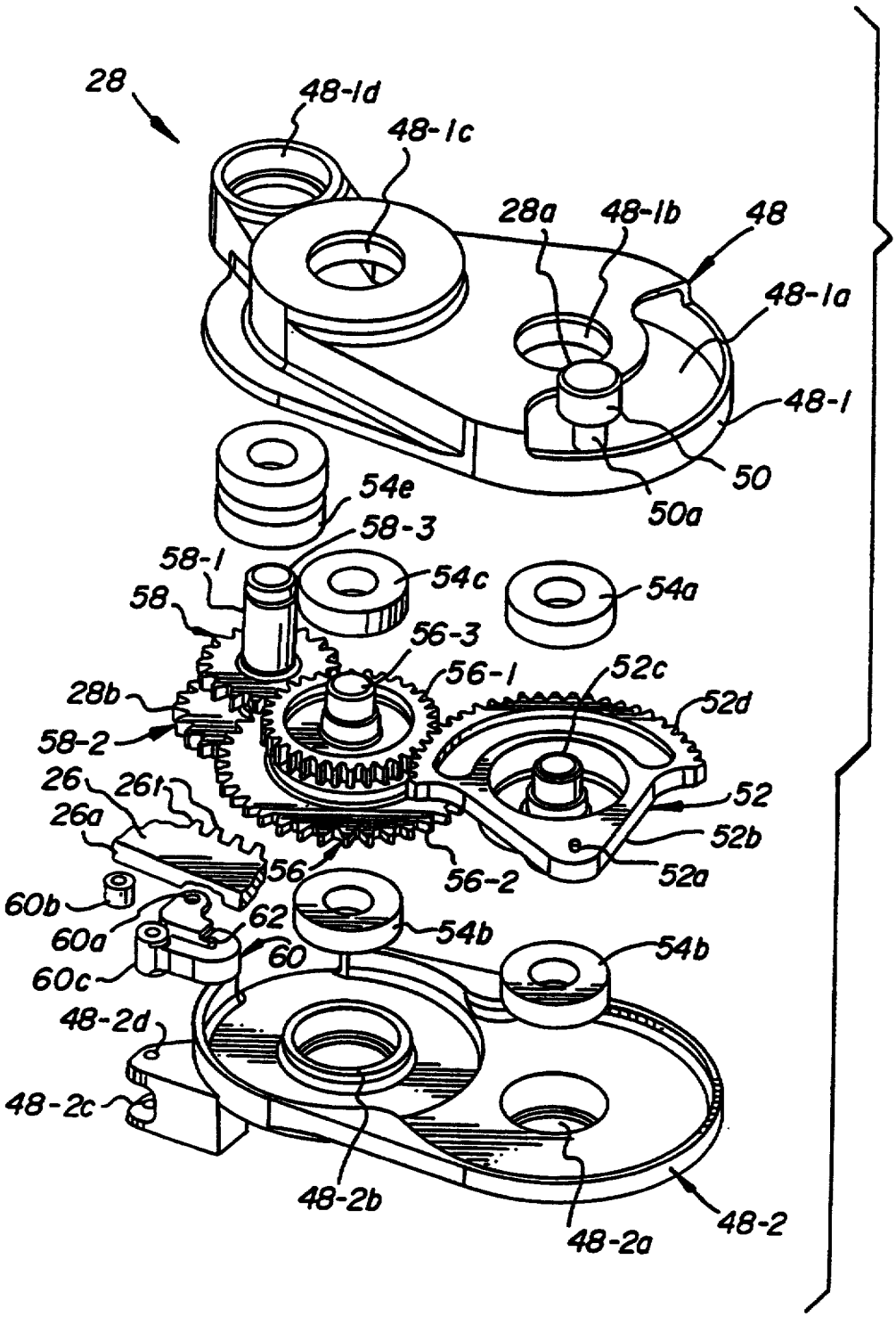
FIG. 4*c* is an exploded view of the gun bolt accelerator mechanism gearing subassembly.

Referring now to FIG. 4c, the accelerator mechanism 28, for moving the rack 26 and attached bolt means 24, is shown. An accelerator housing 48 has an upper portion 48-1 and a lower portion 48-2 which is attached to the barrel extension 15x. The upper housing portion 48-1 has an arcuate aperture 48-1a formed to allow the camming roller 28a, at the outer end of an input member 50, to move along camming channel 14d. Member 50 has a shaft 50a which is affixed at an input location 52a at the end of the body 52b of a sector gear member 52; this gear has a central hub 52c adapted for rotation in support members 54a/54b and retaining apertures 48-1b and 48-2a. A sector gear member portion 52d has teeth of pitch and size to mate with teeth 56-1a of a first toothed gear portion 56-1 of a gear member 56, which also has a second toothed gear portion 56-2 joined thereto on a common shaft 56-3. Gear 56 is supported by means 54c/54d, in housing apertures 48-1c and 48-2b. The teeth of second gear portion 56-2 mate with the teeth of a first toothed gear portion 58-1 of a second gear member 58, having a second toothed gear portion 58-2 which provides the accelerator output 28b to the rack means 26. The second gear member 58 has a shaft 58-3 which is supported in upper housing aperture 48-1d by retainer means 54e. A pressure means 60, having a spring member 60a retained by a retention means 62 operating in apertures 48-2c of a lower housing extension 48-2d, presses a first pressure roller 60b against the back of the rack 26 (opposite the toothed edge 26t thereof) and uses the pressure against an opposite roller 60c to press the rack teeth into mesh with the accelerator output teeth 28b.

When the main operating spring means 18 is charged and the barrel/barrel extension 15x has been latched back in receiver 14, the accelerator roller cam 28a is at the rear end 14d' of the camming channel. Rack 26 has been extended and the bolt means 24 is at its maximum rearward extension from the barrel chamber 14b. This is the 'ready to trigger' position, in which a cartridge has not yet been rotated into alignment with the breech, much less been moved forward into the breech. When the trigger mechanism is activated, the abovedescribed cartridge indexing operation occurs, basically ending with the indexed cartridge 12' in alignment with, but behind, the breech. The barrel extension is unlatched (see FIG. 4b) and starts to move forward, under expansion of the charged operating spring means 18. As the extension 15x moves forward, the accelerator cam roller 28a rolls along channel 14d, from end 14d' through center portion 14d''; this movement rotates sector gear member 52 (say, through an angle on the order of 100°) and, via intermediate gears 56/58, rotates output 28b by an amount sufficient to cause rack 26 to move bolt means 24 forward into engagement with the barrel extension. The bolt face 24b contacts the rear of the cartridge and urges the cartridge forward, into the forward-moving breech (i.e. out-of-battery loading). The displacement, velocity and accelerator of bolt means 24 and cartridge 12, during forward movement thereof are, due to the overall gearing ratio, all greater than the associated displacement, velocity or acceleration of the barrel/extension. In one embodiment, the gearing of means 28 is such that about a 3.5" forward movement of the barrel extension 15x gives about a 6.3" forward movement, or ram, of the cartridge and bolt. We have designed means 28 such that the cartridge 12' is fully chambered at the end of camming channel section 14d'', so that the traversal of the short, straight section 14d''' can be used for locking the bolt to the barrel and for firing the cartridge.

Ignition occurs before the barrel assembly 15 reaches full forward position. Recoil then moves the barrel/extension back along portion 14d''', while the projectile traverses the barrel and the bolt is then unlocked from the extension. During the next rearward portion of travel of the extension, the cam roller movement through central portion 14d'' accelerates the bolt to the rear; the spent cartridge is retained to the bolt by extractor 24x. During spent cartridge movement to the rear, for extraction and ejection, the torque means 19 is being twisted and the main operating spring means 18 are being compressed, in preparation for firing a next round; the barrel/extension assembly locks in its rearmost position, by action of barrel latch 31, and the firing cycle ends.

While one presently preferred embodiment of our novel cartridge indexing mechanism has been described in detail herein, those skilled in the art will recognize that many modifications and variations thereof can be implemented. It is our intent to be limited only by the scope of the appending claims and not by way of the details and instrumentalities describing the embodiment shown herein.

What we claim is:

1. A cartridge indexing mechanism for a weapon having a barrel assembly with a chamber in which is fired a cartridge, responsive to actuation of a trigger mechanism, comprising:

a receiver having a pair of opposed feedports;

means for selecting one of said feedports through which to pass at least one cartridge for loading into said chamber;

a rotary, mechanism for moving through a selected index angle each ammunition cartridge entering through the selected feedport; and torque means for storing energy, responsive to a selected movement of said barrel assembly, until released to operate said rotary mechanism to move, for each selected barrel assembly movement, one cartridge sequentially to a position aligned with said firing chamber, where said torque means includes: a torque rod having a first end fixedly mounted to said receiver and a second end opposite said first end; a wing cam member affixed to said torque rod second end and having first and second complementary camming wings; and first and second cam rollers, only one of which is moved into abutment with an associated one of said camming wings responsive to the selection of an associated feedport, and adapted to rotate the abutting cam wing responsive to said selected barrel assembly movement.

2. The mechanism of claim 1, wherein said torque means is released by actuation of said trigger mechanism.

3. The mechanism of claim 1, wherein said camming wings have adjacent first ends and spaced-apart second ends, with each wing having a cam roller-contacting surface with a concave curve between said first and second ends and complementary to the concave curve of the other cam wing.

4. The mechanism of claim 1, wherein said torque means further includes: a torque tube coaxially disposed about a portion of said torque rod, and having a first end and an opposed second end joined to said rod second end; and pawl means, carried by said tube first end, for interlocking with said rotary mechanism to prevent release of the torque energy stored in at least said rod, until actuated to move said rotary mechanism.

5. The mechanism of claim 1, wherein said rotary mechanism includes: a cartridge movement assembly having a shaft coaxial with said torque rod, said shaft having a first end adjacent said tube first end; and a ratchet gear attached to said shaft first end and interacting with said pawl means to prevent torque means rotation in the selected cartridge movement direction unless said shaft is freed to rotate.

6. The mechanism of claim 5, wherein said shaft has an opposite second end; said cartridge movement assembly further including a buffer member affixed to said shaft second end and interacting with said trigger mechanism to allow said ratchet gear to facilitate torque rod rotation in said selected movement direction only upon actuation of said trigger mechanism.

7. The mechanism of claim 6, wherein said cartridge movement assembly further includes a pair of spaced-apart sprocket members, mounted on said shaft, for carrying the at least one cartridge to be rotated.

8. The mechanism of claim 5, wherein said pawl means comprises: a pawl member having first and second spaced-apart arms, each interacting with said ratchet gear in mutually-exclusive manner; and means, responsive to feedport selection, for moving only one of said pawl arms into contact with said ratchet gear teeth to determine the direction of cartridge rotation.

9. The mechanism of claim 5, wherein said cartridge movement assembly establishes the angle of indexed rotation of a cartridge being moved into alignment with said chamber.

10. The mechanism of claim 9, wherein the indexed angle of rotation is about 60° per indexing mechanism actuation.

11. The mechanism of claim 9, wherein the angle of rotation is established by the amount of rotation imparted to the torque assembly by the moving cam roller.

12. The mechanism of claim 11, wherein the amount of rotation is set by the parameters of the cam wing of said wing cam member.

13. A cartridge indexing mechanism for a weapon having a barrel assembly with a chamber in which is fired a cartridge, responsive to actuation of a trigger mechanism, comprising:

a receiver having a pair of opposed feedports;

means for selecting one of said feedports through which to pass at least one cartridge for loading into said chamber;

rotary mechanism for moving through a selected index angle each ammunition cartridge entering through the selected feedport;

torque means for storing energy, responsive to a selected movement of said barrel assembly, until released to operate said rotary mechanism to move, for each selected barrel assembly movement, one cartridge sequentially to a position aligned with said firing chamber; and means for latching said barrel assembly into a static condition, and one of said rotary mechanism and said torque means include means for unlatching said barrel assembly as a cartridge is rotated into chamber alignment.

* * * * *